US005295927A

United States Patent [19]

Easley et al.

[11] Patent Number: 5,295,927

[45] Date of Patent: Mar. 22, 1994

[54] STEPPER EXERCISE MACHINE

[75] Inventors: James B. Easley, Minneapolis; Adolf H. Friedebach, Waconia; Paul M. Theisen, Shakopee; John E. Titus, Savage, all of Minn.

[73] Assignee: Fitness Master, Inc., Waconia, Minn.

[21] Appl. No.: 920,780

[22] Filed: Jul. 28, 1992

Related U.S. Application Data

[63] Continuation-in-part of Ser. No. 800,554, Nov. 27, 1991, Pat. No. 5,199,931.

[51] Int. Cl.[5] ..... A63B 22/04

[52] U.S. Cl. ..... 482/52; 482/51

[58] Field of Search ..... 482/70, 51, 52, 53, 482/4, 5, 6, 57, 63; 128/25 R

[56] References Cited

U.S. PATENT DOCUMENTS

| | | | |
|---|---|---|---|
| D. 328,770 | 8/1992 | Henderson et al. . | |
| 3,970,302 | 7/1976 | McFee . | |
| 4,496,147 | 1/1985 | DeCloux et al. . | |
| 4,685,666 | 8/1987 | DeCloux . | |
| 4,685,669 | 8/1987 | DeCloux . | |
| 4,733,858 | 3/1988 | Lan . | |
| 4,848,737 | 7/1989 | Ehrenfield | 482/52 |
| 4,958,830 | 9/1990 | Huggins et al. | 482/51 |
| 4,982,952 | 1/1991 | Wang . | |
| 4,989,857 | 2/1991 | Kuo . | |
| 5,000,441 | 3/1991 | Wang . | |
| 5,007,631 | 4/1991 | Wang . | |
| 5,033,733 | 7/1991 | Findlay | 482/52 |
| 5,039,087 | 8/1991 | Kuo | 482/52 |
| 5,040,785 | 8/1991 | Charnitski | 482/52 |
| 5,145,476 | 9/1992 | Chiarello . | |

*Primary Examiner*—Stephen R. Crow
*Attorney, Agent, or Firm*—Dorsey & Whitney

[57] ABSTRACT

An improved stair climbing exercise machine is provided. The machine biomechanically simulates climbing stairs to provide exercise for a user and broadly includes a support frame, right and left foot-receiving pedals, and a drive system. The frame includes a base and a generally tubular, inclined slide mast. The pedals are mounted on respective independently moveable shuttles slidably received in channels at each side of the mast. The electrically released drive system is operably coupled to the pedals and includes a multiple pulley and strap arrangement.

10 Claims, 5 Drawing Sheets

40
18
142
140
41
79
150
80
152
32
136
34
76
10
36
100
146
144
5
88
5
4
82
86
14
15
27
90
30
12
A
182
78
16
108
42
182
81
6
6
20
26
24
38
25
154
27
166
126
182
116
42
22
25

STEPPER EXERCISE MACHINE

This patent application is a continuation-in-part of U.S. Pat. application Ser. No. 800,554, filed Nov. 27, 1991, now U.S. Pat. No. 5,199,931.

TECHNICAL FIELD

The present invention relates to exercise machines. More particularly, it relates to an electrical exercise machine that simulates climbing stairs to provide exercise.

BACKGROUND OF THE INVENTION

Interest in health and fitness has precipitated the development of diverse exercise machines and devices including simple inclined platforms, stationary bicycles, treadmills, multi-functional exercise frames, and, most recently, stair-climbing simulators. The latter devices attempt to simulate the biomechanical activity and effect of a person raising his or her body weight from a lower step to a higher step, typically by requiring an exerciser to keep the body in the same place while the steps move, that is, by shifting body weight repeatedly from one foot to the other, optionally against variable resistance. The user's feet generally are received on moving or movable foot receiving members. Separate foot receiving members are common, either moving continuously in one direction or alternating between an upper position and a lower position. In the latter case, as one foot of the user presses down on a foot-receiving member in its upper position, that member is driven down against resistance. Generally, the second member will be rising at the same time. When the second member reaches its upper position, the user presses down on it with the other foot, raising the weight of the body or at least keeping it in the same place, and driving the second member down.

Representative examples of fairly early stair climbing devices include the types of devices disclosed in U.S. Pat. Nos. 3,497,215 (to Harrison), 3,743,283 (to Garrett), 4,340,218 (to Wilkinson), 4,687,195 (to Potts), 4,555,108 (to Monterio), and 4,726,581 (to Chang). These patents reflect the development of stair simulators, disclosing substantially static steps (the Garrett and Wilkinson patents) or an escalator-like plurality of moving steps connected to endless chains (the Harrison, Chang and Potts patents). The patent to Monterio discloses two sets of circumferential steps mounted on a rotatable member.

U.S. Pat. Nos. 3,970,302 (to McFee) and 4,496,147 (to DeCloux et al.) disclose a pair of reciprocally movable foot receiving supports carried by inclined track members. In use, the user steps on one foot support while removing weight from the second. The foot support without weight rises, while the support bearing weight descends at a rate determined by the resistance. When the downwardly traveling support reaches the end of travel, the user transfers his or her weight to the other foot and the motion of the supports reverses. The McFee and DeCloux et al. patents also disclose resistance systems, including shock absorbers or hydraulic systems, used in this type of device, and in stair simulators generally.

While the above prior art devices are useful, some of them are rather large for in-home use, they may not provide optimal muscle toning or aerobic exercise workouts, they require reciprocal leg motion, and they may be quite noisy.

U.S. Pat. No. 4,708,338 (to Potts) is fairly representative of the modern approach to solving at least some of the foregoing problems by providing a stair climbing exercise apparatus wherein a right and left pedal alternately and independently oscillate between an upper rest position and a lower position attained by the weight of or force generated by the user. As is typical in this type of machine, the pedals drive a drive sprocket in one direction through one-way clutches and are returned to their upper position by a coil spring. In this Potts device an alternator acts as a dynamic brake for providing resistance. Somewhat similar exercise machines are disclosed in U.S. Pat. Nos. 4,938,474 (to Sweeney et al.), 4,943,049 (to Lo), 4,949,993 (to Stark et al.), 5,013,031 and 5,054,770 (to Bull), 5,048,821 (to Kuo-Liang), 5,078,390 (to Hurt) and 5,033,733 (to Findlay). The Findlay apparatus includes the typical arrangement of two side-by-side steps mounted on bars pivotally connected to a frame. A cable or strap connects each step to a spring-driven pulley, and the pulleys are connected via a one-way clutch to a drive shaft. The shaft drives a multiple planetary gear arrangement, the output of which drives a rotary member having an electro-magnetic resistance element.

U.S. Pat. No. 5,039,087 (to Kuo) discloses a powered stair climber that includes pivotally mounted pedals. The climber has a gear which has two driving rods mounted at one side thereof and arranged at opposite directions. The pedals have lugs for connection to the driving rods and the gear is meshed with a worm gear on top of which there is mounted a pulley, in turn connected with a motor via a belt. FIG. 3 shows that when the motor starts rotating, the worm gear will rotate in unison therewith by means of the belt and pulley, then the gear meshed with the worm gear rotates and, since the driving rods are at opposite directions, they turn the cranks moving one pedal up and the other pedal down. Thus, an exerciser rides or stands passively on the pedals and does a stair climbing exercise when the motor is turned on. The pedals reciprocate, that is, when one moves up the other moves down and vice versa. U.S. Pat. No. 4,989,857 (to Kuo) discloses a similar stair climber with a safety speed changing device, but without a worm gear.

U.S. Pat. No. 5,007,631 (to Leao Wang) discloses a climbing exerciser having a frame body with two parallel channel bars obliquely set at each side. A sliding rod is set to slide in each bar. The sliding rods carry handles at their upper end and pedals at their lower end. The pedals include links that are connected to a cord that rotates a free wheel alternately in opposite directions.

U.S. Pat. Nos. 4,982,952 and 5,000,441 (to Shui-Mu Wang) both disclose devices including a base and an elongated prop extending upward from the base. In the earlier patent, upper and lower longitudinal slide grooves receive first left and right slide pieces (in the upper grooves) and second left and right slide pieces (in the lower slide grooves). The second slide pieces each have a foot support piece and are connected to the first slide pieces. The pieces reciprocate and resistance is provided by hydraulic cylinders. Each of the four slide pieces includes rollers B and D. In the later patent, the typical pedals disclosed in many of the above-noted patents replace the lower, second slide pieces.

U.S. Pat. No. 4,848,737 (to Ehrenfield) discloses a moving ladder exercise device including a retarder assembly (shown in FIG. 3). The retarder assembly includes an electric motor, drive shaft, worm gear assembly and clutch mechanism. FIG. 4 shows that "the chain drive sprocket 41 is forced by operator weight to rotate as shown by arrow 42. Unidirectional clutch 33 locks thereby translating torque into worm gear mechanism 32. However, no feed through to electric motor 31 can occur since the worm drive isolates the motor from the driving force. When rotation of the ladder sprocket stops or drops below the speed of the worm drive output, then clutch 33 disengages so that the motion depicted by arrow 42 cannot be transmitted to the ladder. By these means, the moving ladder is powered only by operator weight and never by the electric motor-worm drive assembly." (Ehrenfield patent, column 3, lines 31–45)

While the above-cited patents reflect refinements in the exercise machine art and progressive, general improvement in stair climbing simulators, it is clear that with current in-home stair-climbing simulating devices cost efficient manufacture, smoothness, fluidity, safety and quietness are not optimized. There is a need for a reasonably priced, biomechanically and ergonomically sound, aesthetically pleasing stair climbing simulator or "stepper" exercise machine that the exerciser enjoys using because the machine is attractive, quiet, self-prompting and has a smooth, fluid motion.

SUMMARY OF THE INVENTION

In accordance with the present invention, an improved stair climbing exercise machine is provided. The machine biomechanically simulates climbing stairs to provide exercise for a user and broadly comprises a support frame including a generally tubular, inclined slide, right and left foot receiving pedals mounted on associated independent shuttles, and an electrically released drive system, including a multiple pulley and strap arrangement, operatively coupled to the pedals.

The frame is formed of generally hollow or tubular frame members and includes an articulated base, front and rear crossmembers, and an upright slide mast. A handlebar arrangement is mounted adjacent the upper end of the mast, as is a control and display unit which may be adapted to provide suitable and desirable control and display features.

The independently operable right and left pedals are connected to the respective shuttles at an integral, generally perpendicular outstanding cantilevered beam. The shuttles are received in parallel channels, one on each side of the slide mast. The drive system independently connects each shuttle, and therefore the pedals, to a single drive shaft rotatable in one direction, broadly transmitting the force exerted by the user upon the pedals to the drive shaft. The drive shaft is connected to an electric motor through a worm gear assembly. The drive system, specifically the motor, does not literally "drive" or move the pedals, rather, it acts as a release mechanism permitting force exerted by a user to move the pedals, and it is only when the machine is turned on that a user can move the pedals.

A feature of the exercise machine of the present invention is a drive system that maximizes smooth, fluid motion, as well as relatively easy initial movement, of the pedals by incorporating a first drive portion, comprising two independent parallel drive linkages, a right drive linkage and a left drive linkage, linking each pedal to the single rotatable drive shaft. As is also disclosed in U.S. Pat. application Ser. No. 800,554, entitled "Exercise Machine for Simulating Stair Climbing" and owned by the assignee of the present invention, each drive linkage includes a continuous fabric-like web or strap having two ends, a first end connected to the associated pedal shuttle and a second end connected to a reel-like, recoil assembly including a one-way clutch and spool having a hub operably mounted on the one-way clutch. Each recoil assembly is mounted on the drive shaft. In both the right and left drive linkages the strap passes over at least one independent idler roller pulley or sheave between its two ends. A concentric, flat, clock-wound return spring is inside each spool and is operably connected to the hub of the spool.

Another feature of the present invention is a single stage reduction worm assembly or set comprising a worm pinion gear operably mounted on the depending output shaft of an electric motor housed in the base of the machine and a driven worm gear, generally centrally and fixedly mounted on the drive shaft between the recoil assemblies, whereby it is driven in the same single direction as the drive shaft.

An object of the present invention is to provide a stair climbing simulator that is inexpensive to manufacture, durable, provides safe, non-jarring aerobic exercise for a user and provides an electric motor controlled rate of descent or exercise which cannot be changed or overcome by a user exerting more force on the pedals.

Another object of the present invention is to provide a stair climbing exercise machine that offers exercise movements, feel and control of the type previously provided only by institutional quality equipment.

Other objects of the present invention are to provide an exercise device that is attractive and compact enough to be used conveniently in a home without wasting valuable storage or living space, and to provide a device that may be purchased for home use at a reasonable cost.

Yet another object of the present invention is to provide a stair climbing simulating exercise device that a user will enjoy using.

Yet another feature of the present invention is that the exercise effort level or workout intensity can be adjusted. Specifically, the speed of the non-backdriveable electric motor is selectably variable among various operating speeds. When the machine is on and the worm assembly is in motion, a user standing on the pedals or exercising by effecting a stair-climbing motion will be in a constant falling mode and the rate of fall will be controlled by the selected motor operating speed. If the user fails to keep up with the speed setting, the pedals will fall to their bottom reach of travel, and if the user steps faster than the selected speed setting, the pedals will contact or be at their uppermost, top reach of travel.

Other features include an optional mechanical, electro-optical, or electromechanical counter for counting the number of strokes of one or both pedals, non-slip foot receiving surfaces on each pedal, and a handlebar adapted to be used comfortably in more than one exercising position. The base and slide mast containing or housing the drive system, including the straps, are formed suitably by attractively finished molded plastic and extruded, anodized aluminum, respectively, although other suitable materials may be used as well.

In use, the user grasps the handlebar and places respective feet on the footpedals which will be in an uppermost rest position by virtue of the clock-wound return springs which have wound the straps onto themselves on the spool in the opposite direction relative to the direction the drive shaft is turned by the motor. The machine is turned on and the weight of the user will cause one or both pedals to sink toward their lowermost position. The user begins exercising by taking body weight off one of the pedals, allowing that pedal to rise, then transferring or shifting the weight to that pedal by elevating the body as in climbing a step. Thus, the exercise is from "climbing", not merely from the shifting of weight.

Because the pedals are independently operable, the user can select a comfortable length for the stepping or stair climbing stride. The user selects or programs a rate of exercise by selecting a motor operating speed from a variety of such speeds. The selected speed may not be exceeded by the user, that is, the motor is isolated by the worm assembly from the user-produced driving force.

When the user has received a sufficient work out, the weight transfer from foot to foot is stopped and both pedals will move downwardly to their lowermost position under the weight of the user, who may then simply step off. The machine may be turned off and the clock-wound return springs will gently return the pedals to their uppermost position.

One of the important advantages of the present invention is that it improves the smoothness and fluidity of the exercise motion, as well as the safety of mounting and dismounting. Smoothness and fluidity is achieved by using straps or belts to completely replace the roller chain and sprocket or planetary gear arrangements used in prior art devices. This reduces backlash and roughness caused by the clearance or play between the sprocket teeth and chains or gears previously used. Additional smoothness, particularly a smooth, easy initial movement of the pedals, is enabled by the mechanical advantage produced by the multiple pulley arrangement connecting the pedals to the drive shaft. The pulley and strap arrangement also helps eliminate dead spots at the reach of pedal travel, particularly at the initial, uppermost position the pedals are in prior to beginning the downward power stroke. Additionally, at each end of travel the pedals have a soft landing created by upper and lower shuttle stops. The clock-wound return springs return the pedals upwardly to their rest position in a smooth, easy motion, thereby reducing the chances of injury to a user while dismounting.

Other advantages of the present invention are that it has an aesthetically pleasing appearance. It is easy to use, light enough, and foldable so that it may be moved easily within the home. The machine of the present invention can provide work-outs ranging from gentle rehabilitative exercise for persons with special needs to extremely intense conditioning or aerobic work-outs for athletes. The present invention is stable in use because the mass of the operating mechanism, particularly the motor, worm gear assembly and recoil assemblies, is centrally located near the base, giving the machine a low center of gravity.

Other objects, features and advantages of the present invention will become more fully apparent and understood with reference to the following specification and to the appended drawings and claims.

DETAILED DESCRIPTION OF THE PREFERRED EMBODIMENT

Figure 1:
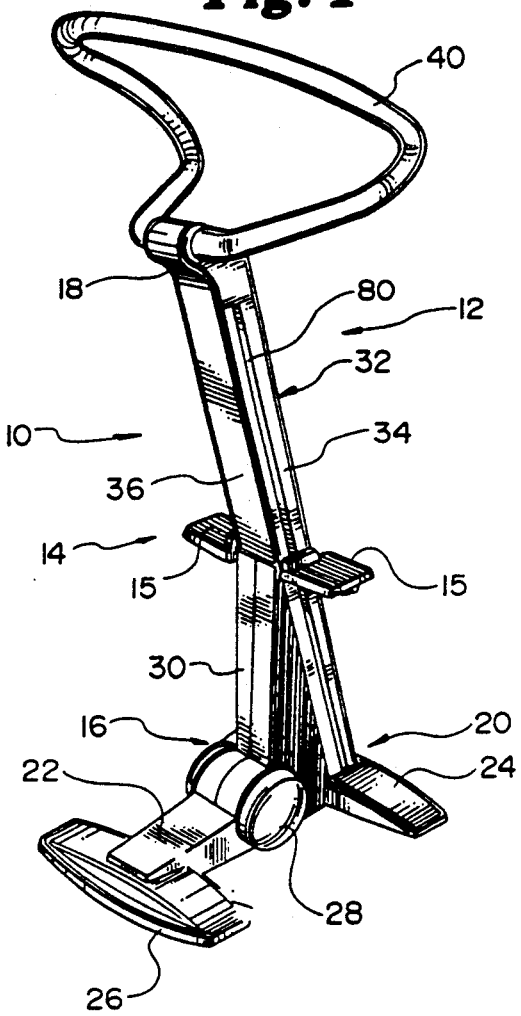
FIG. 1 is a perspective view of the exercise machine of the present invention.

Referring to FIGS. 1–7, the stair-climbing simulating exercise machine 10 of the prevent invention broadly comprises a support frame 12, right and left foot-receiving pedals 14, with non-slip surfaces 15, and a drive system 16 substantially contained or housed in the lower portions of the support frame 12.

The support frame 12 is substantially tubular and hollow and includes an uppermost head end 18 and a base 20. The base 20 includes a generally central, hollow bridge member 22 and front and rear cross members 24, 26, respectively. The front and rear cross members 24, 26 are adapted to provide a flat underside, which may be provided with feet 25, whereby the exercise machine 10 of the present invention rests securely on the floor. Between the cross members 24, 26, immediately adjacent to and integrally with the bridge 22, the base 16 includes a rewind and trunnion cover 28. A hollow upper support bridge member 30 is integral with the male and female halves of the trunnion cover 28 and extends generally perpendicularly upwardly from the base 20 adjacent the front cross member 24. The upper support bridge member 30 is generally hollow, having upper and lower vents 27, and may be formed suitably from a clam shell arrangement of appropriately molded plastic or like material. The upper bridge support member 30 supports the generally vertical slide mast 32 which includes a front upper track 34 and a rear lower track 36. While generally vertical, the mast 32 rises from the base 20 at approximately a 70° angle. With reference to FIG. 3, the bottom end of the mast 32 is received in a flattened V-shaped saddle 38 in the front cross member 24. A handle bar 40 is movably mounted at the head end 18 of the support frame 12, is held in place by a clamp arrangement 41, and, as depicted in FIG. 2, may be moved between a first, exercising position (FIG. 1) and a second, storage position (depicted in phantom in FIG. 2).

Figure 2:
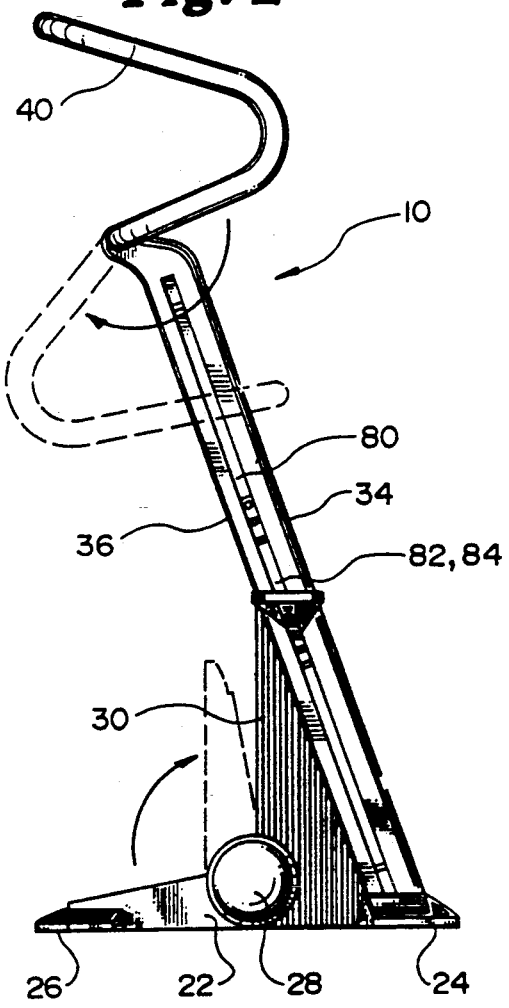
FIG. 2 is a right side elevational view of the present invention, depicting certain moveable and foldable parts thereof, specifically, the handlebar and base, in a second position in dashed lines.
Figure 3C:
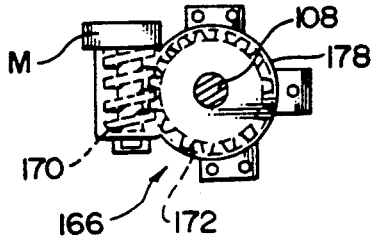
FIG. 3C is an elevational detail of the worm assembly of the present invention, simplified for clarity.
Figures 3, 3A, 3B:
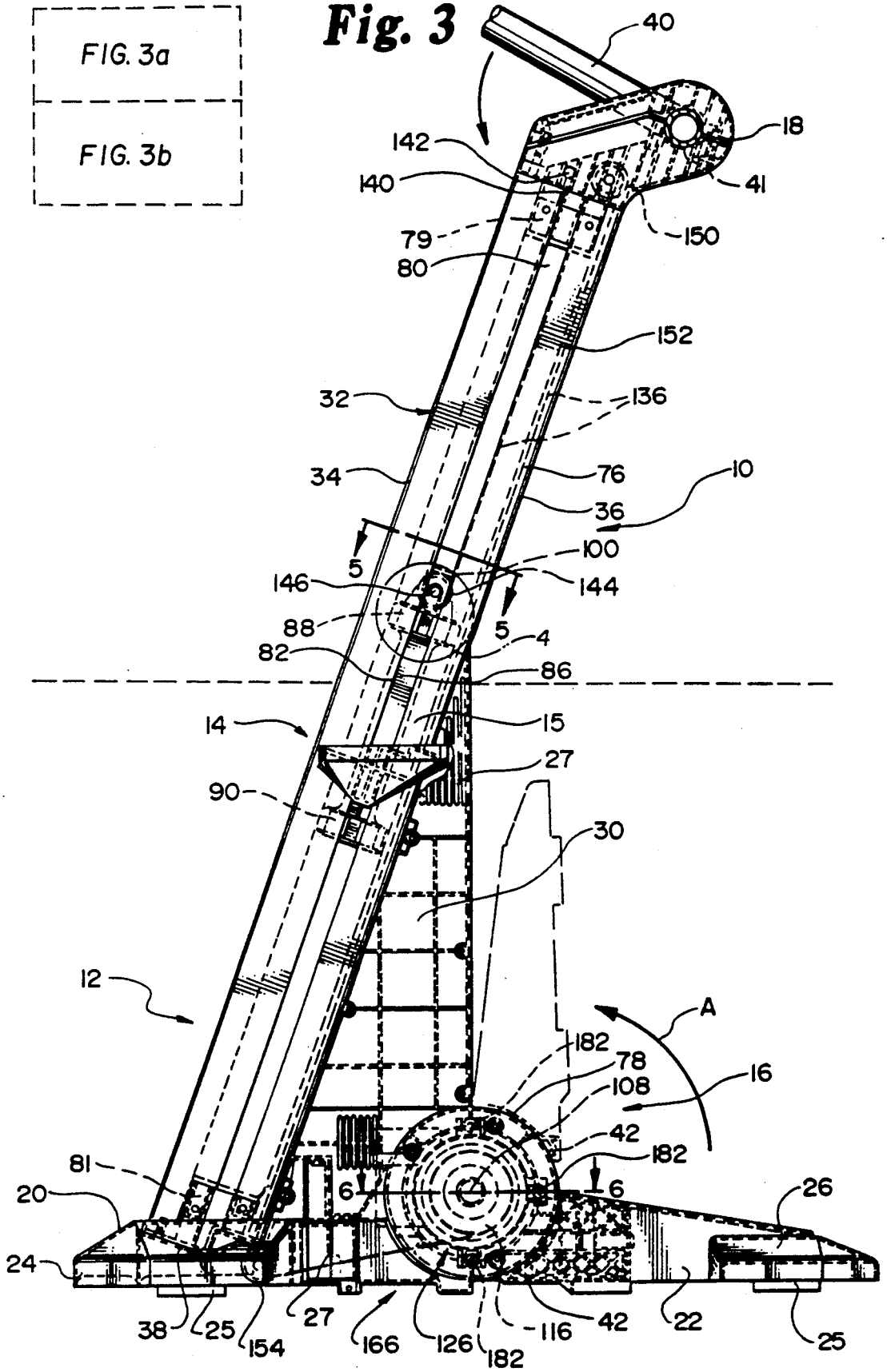
FIG. 3 is a left side elevational view of the present invention.

With continued reference to FIGS. 2 and 3, the rear cross member 26 is pivotally or foldably connected to the base 20 at the rewind and trunnion cover 28. FIG. 3, particularly arrow A, depicts the movement of the bridge 22 and rear cross member 26 into a storage position closely adjacent the upper support bridge member 30. The rear cross member 26 is locked in its deployed position generally coplanar with the front cross member 24 by a latch hook mechanism 42.

Figure 7:
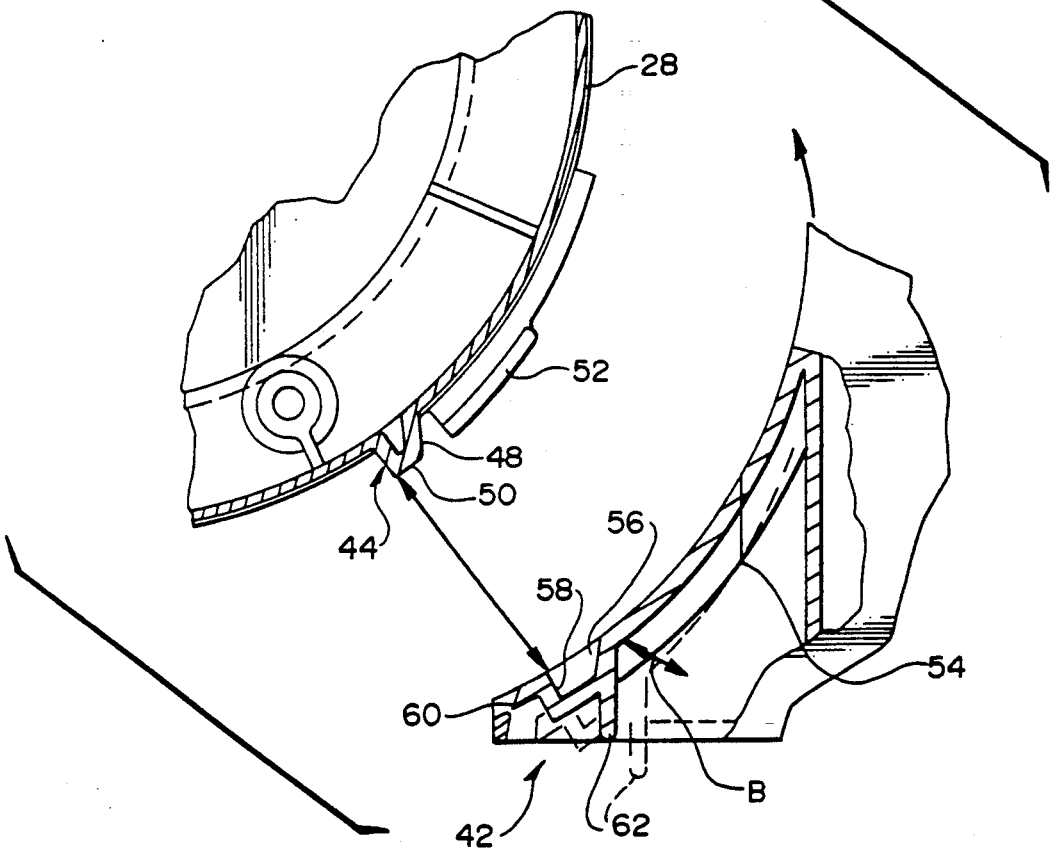
FIG. 7 is an enlarged fragmentary exploded detail view depicting the area encircled at 7 in FIG. 3 with parts cut away for clarity.

Referring to FIG. 7, the latch hook mechanism 42 comprises a latch pawl 44 integrated with the rewind and trunnion cover 28. The pawl 44 includes or has a strike surface 46, a ramp 48 and an outermost land 50. Adjacent the pawl 44, the edge of the rewind and trunnion cover 28 includes an arcuate guide 52. The guide is received along the forward facing edge of the bridge 22 which also supports an integral leaf spring 54. The leaf spring 54 includes a pawl seat 56 generally corresponding in shape to the pawl 44 and including a receiving surface 58 for contacting the strike surface 46 of the pawl 44. The spring 54 terminates in a spring tip 60. Adjacent the tip 60 is an outstanding finger receiving operating tab 62. Arrow B in FIG. 7 depicts the motion of the integral leaf spring 54 and the latch hook mechanism 42 generally.

Figure 5:
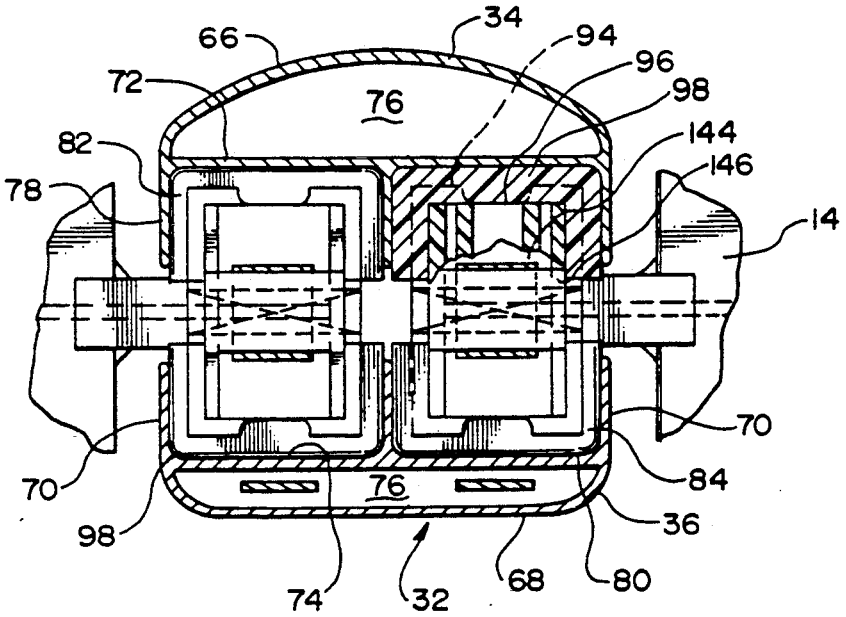
FIG. 5 is an enlarged fragmentary section taken along line 5—5 of FIG. 3 with parts cut away for clarity.

Referring to FIG. 5, the slide mast 32, specifically the upper track 34 and the lower track 36, include generally front facing and rear facing cosmetic walls 66, 68, respectively. The tracks 34, 36 also are defined by and include sidewalls 70, an internal front wall 72, an internal lower track wall 74 and central, coplanar divider walls 75. Between the track walls 72, 74 and the cosmetic walls 66, 68, each track 34, 36 includes a void 76. Together, the upper and lower tracks 34, 36, respectively, define a pair of substantially closed, parallel slide channels, including a right channel 78 and a left channel 80. The upper and lower tracks 34, 36 are kept aligned and maintained in proper relationship by the upper and lower pedal shuttle stops 79, 81, respectively, and because the mast 32 is mounted in the saddle 38. The head end 18 also locks the two tracks 34, 36 together.

Referring to the Figs., particularly FIG. 5, the pedals 14 are supported or carried by right and left pedal carriage shuttles 82, 84. The right and left pedal and shuttle arrangements are independent relative to each other, yet are substantially identical, and therefore, the various structures and features of each shuttle 82, 84 will be described with reference to common reference characters.

Figure 4:
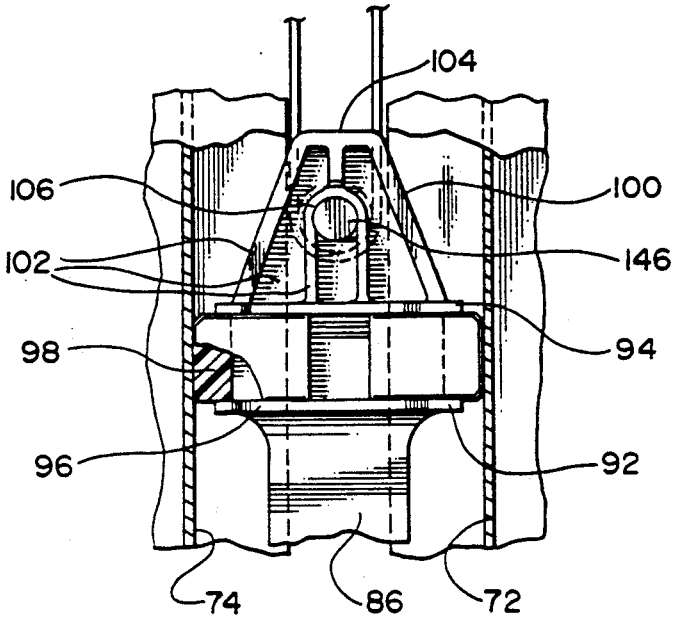
FIG. 4 is an enlarged fragmentary detail view depicting the area encircled at 4 in FIG. 3.

Referring to FIG. 3, each shuttle carriage 82, 84 includes a body shank 86 and upper and lower expanded glide portions 88, 90, respectively. The upper and lower glide portions 88, 90 of each shuttle 82, 84 are substantially identical and therefore, will be described with reference to FIG. 4, depicting an upper glide portion 88. The glide portions 88, 90 include a first flange 92 carried by the shank 86. A second flange 94 is generally spaced from and parallel to the first flange 92. The flanges defined a guide seat 96 therebetween for receiving generally U-shaped upper and lower glide members 98. The glides 98 are adapted to fit closely and tightly in the parallel channels 78, 80 defined by the upper and lower tracks 34, 36 and may be made from or coated with suitable relatively low-friction material. Examples of such materials are ultra-high molecular weight resins, common acetyl bases with "TEFLON" impregnation, or other suitable plastics or polymers. Such material are commercially available from DuPont, Shambam and others.

With continued reference to FIG. 4, the uppermost end of each shuttle carriage 82, 84 includes a pulley housing 100 formed by generally upstanding web gusset arrangements 102. The gussets 102, and the shuttles 82, 84, terminate in an uppermost axle bridge 104. The web gusset 102 support an axle mount 106.

Figure 6:
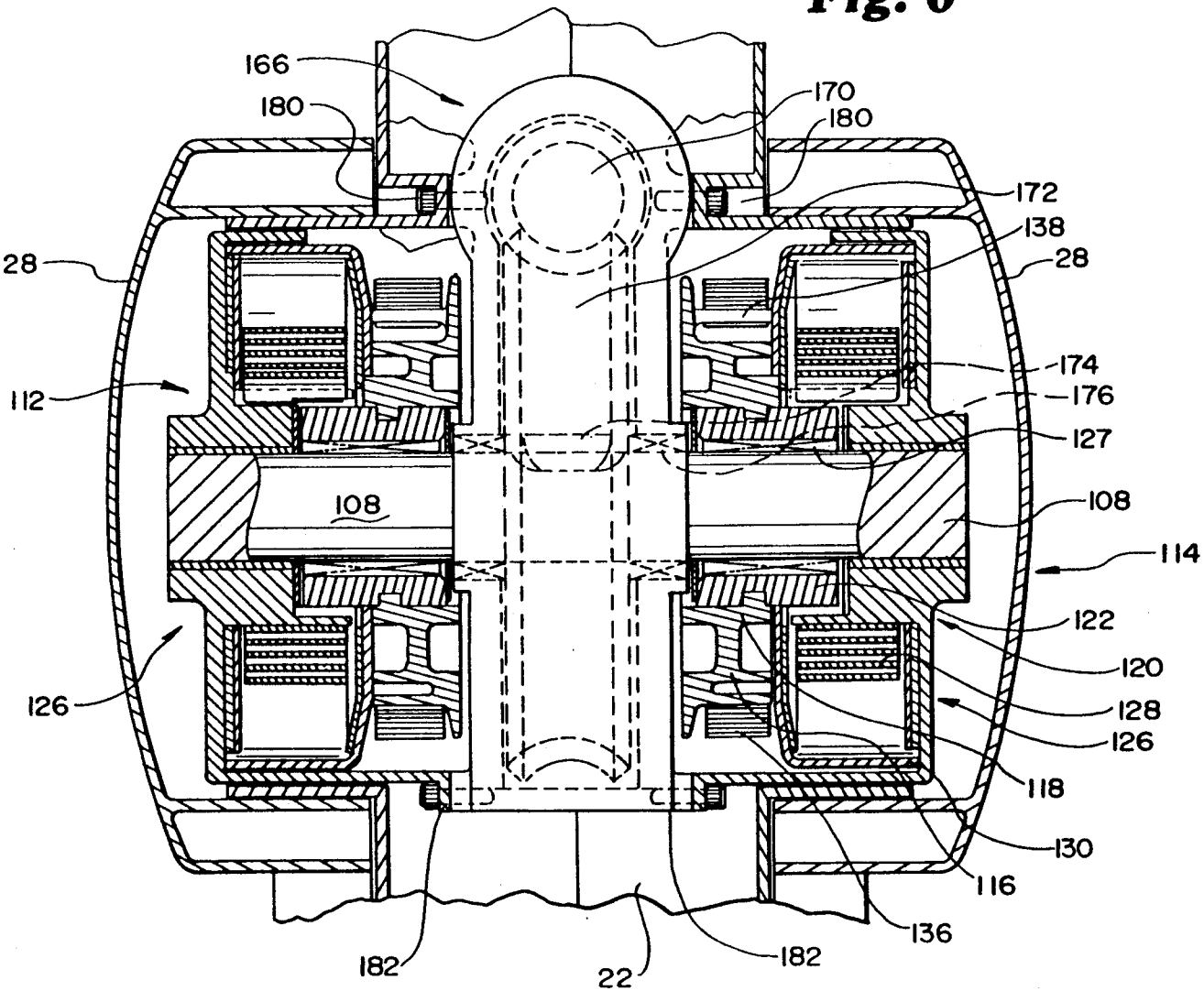
FIG. 6 is an enlarged fragmentary section taken along line 6—6 of FIG. 3 with details of the recoil assemblies of the present invention depicted.

Referring to FIGS. 3*a*, 3*b* and 6, the drive system 16 of the exercise machine 10 of the present invention broadly comprises a first drive portion including independent and substantially identical right and left linkages for connecting the right and left foot pedals 14 to a single drive shaft 108 rotatable in a single direction and supported by a hollow pillow block and bearing arrangement 110, depicted in FIG. 6. With continued reference to FIG. 6, these linkages include right and left clutch and rewind assemblies 112, 114. Each assembly 112, 114 is substantially identical and, therefore, only one assembly (114) will be described. The clutch and rewind assembly 114 includes a hollow spool 116 with a central cylindrical hub 118. The spool 116 is mounted on the drive shaft 108 on a typical one-way clutch 120 received in the hub 118. The clutch 120 includes clutch housing 122 and clutch bearing 124. The spool 116 is rotatable in both of the two possible directions around the one-way clutch 120, while the drive shaft 108 is driven in only one direction because of the engagement and disengagement of the one-way clutch 120. The spool 116 carries a rewinding recoil assembly 126, including a clock wound spring 128 housed in a spring cover 130. An elongated continuous web or fabric-like belt or strap 136 is wound about the outer diameter of each spool 116. The strap 136 has a first terminal end 138 operably coupled to the spool 116. Referring to FIG. 3, the second end 140 of the strap 136 is fixedly connected to the head end 18, more specifically, at a strap terminal pin 142.

With continued reference to FIG. 3, the first portion of the drive system 16 operably connects the foot pedals 14 and the drive shaft 108. More specifically, the second end 140 of each strap 136 is fixedly coupled to the pin 142. Each strap 136 runs or extends generally downwardly and is received about a first movable primary guide idler roller pulley 144 carried by each shuttle 82, 84 on an axle 146 in the pulley housing 100. The straps 136, which are parallel to each other, then pass or run back upwardly and are received about or travel around a secondary fixed idler pulley 150 mounted fixedly in the head 18. After passing around the secondary idler pulley 150, each strap 136 has a long parallel run 152 in the void 76 in the rear lower track 36 to a third idler pulley 154 mounted in the front cross member 24. The straps 136 are connected at their terminal ends 138 to the take-up spools 116 of the rewind assemblies 126. Thus, the independent parallel multiple pulley and single strap arrangements create three generally parallel runs for each strap 136 and, because the shuttle carried pulley 144 is movable, create a mechanical "block and tackle" advantage, enabling the relatively easy initial movement of the pedals 14.

The operation of the recoil assemblies 126 of the present invention are substantially similar to the operation of the first portion of the drive system disclosed in U.S. Pat. Application Ser. No. 800,544. In summary, the downward power stroke of each pedal 14 of the present invention unrolls or unwinds the strap 136, thereby acting on the spool 116 and the shaft 108 at the same time, while the rotation of the spool 116 winds the clock-wound return spring 128 into increasing tension. When the pedals 14 are at their lowermost reach at the bottom pedal or shuttle stop 81, the strap 136 will be nearly fully unwound from the spool 116 and the clock-wound spring 128 will be at maximum tension about the hub 118. When the user's weight is removed from a pedal 14, the work stored in the spring 128 causes the retraction or rewinding of the strap 136 about the spool, thereby pulling that pedal 14 upwardly toward the top pedal or shuttle stop 79.

With reference to FIGS. 3, 3C and 6, the second portion of the drive system 16 of the present invention comprises a non-backdriveable pedal releasing worm and electric motor assembly 166. The mating halves of the rewind and trunnion cover 28 house or contain the worm and motor assembly 166. The assembly 166 includes a commercially available electric motor "M" having a typical output shaft 168 to which is operably connected or keyed a worm pinion 170. The worm pinion 170 has a helix or lead angle ranging from 3° to 4.9°, being preferred, and is drivingly interconnected to a driven worm gear 172. The driven worm gear 172 is keyed or fixed to the drive shaft 108 by a key 174. The driven worm gear 172 is housed in a gear housing 178 and is fixed to the drive shaft 108 between the recoil assemblies 126. The gear housing 178 is mounted to the "clam shell" mating halves of the rewind and trunnion cover 28 at a plurality of three worm gear box mounts 180. The pillow block 110 for supporting the drive shaft 108 is connected to the gear housing 178 at three pillow block mounts 182.

Advantages of the present invention are that the exerciser may slow the pace of exercise gradually, allowing for a "warm-down" period following periods of more intense exercise. Once the exerciser has finished the workout, he or she may simply stand still on the pedals 14 which will sink slowly and gradually to the lowermost position under the weight of the exerciser. Upon stepping off from the machine, the pedals 14 will return smoothly and gently to the uppermost position of rest, whereupon they are ready for another exerciser or exercise session.

The present invention can be changed by modifying the shape of the shroud or cover 28 or pedals 14. The shape of the handlebar 40 can be varied or a handlebar integrated with the mast 32 might be used. Additionally, the handlebar 40 may be wrapped with various appropriate materials including sponge or tape. The exercise machine 10 might be provided with indicia, labeling or instructions as deemed appropriate. The device 10 of the present invention optionally might include an electronic sensing, calculating and display system, including a counter or timer, for determining and showing the amount of work an exerciser has done.

Although a description of the preferred embodiment has been presented, it is contemplated that various changes, including those mentioned above, could be made without deviating from the spirit of the present invention. It is desired, therefore, that the present invention be considered in all respects as illustrative, not restrictive, and that reference be made to the appended claims rather than to the foregoing description to indicate the scope of the invention.

What is claimed is:

1. An improved stair climbing exercise machine comprising:

a support frame having a tubular slide mast;

right and left pedals movably carried by said mast; and electrically released drive means comprising an electric motor, a single drive shaft rotatable in one direction, drive linkage means for independently linking each pedal to said drive shaft, and worm means for operably coupling said motor to said drive shaft.

2. The exercise machine according to claim 1, wherein said pedals are mounted on respective independently movable shuttles slidably received in channels at each side of the mast.

3. The exercise machine according to claim 2, wherein said worm means comprises a worm operably coupled to said motor and a worm gear mounted on said drive shaft.

4. An improved stair climbing exercise machine comprising:

a support frame, having a base and generally tubular inclined slide mast;

right and left foot-receiving pedals mounted on respective independently moveable shuttles slidably received in channels at each side of said mast; and electrically released drive means including an electric motor, a single drive shaft rotatable in one direction, drive linkage means for independently linking each pedal to said drive shaft, and worm means for operable coupling said motor to said drive shaft, said worm means comprising a worm operably coupled to said motor and a worm gear mounted on said drive shaft, said drive linkage means comprising substantially similar independent right and left drive linkages, each linking the associated right and left pedal to said drive shaft, whereby the movement of the pedals is transferred to said drive shaft, each linkage including a recoil assembly mounted on said drive shaft and a continuous linking means for linking said recoil assembly and the associated pedal, said linking means having a first end connected to the recoil assembly, a second end connected to said frame, and an intermediate portion including at least two generally parallel runs adapted to move in opposite directions relative to each other when the associated pedal is moved, said generally parallel runs being received at each end thereof by independent idler means for receiving said linking means.

5. The exercise machine according to claim 4, wherein said support frame includes a rear cross member foldably connected to said base, whereby said rear cross member can be pivoted into a storage position and a deployed position.

6. The exercise machine according to claim 5, wherein said base includes a latch means for releasably locking said rear cross member in said deployed position.

7. An improved stair climbing exercise machine comprising:

a support frame having a tubular slide mast;

electrically released drive means; and right and left pedals mounted on respective independently movable shuttles slidably received in channels at each side of said mast, each said shuttle having upper and lower glide portions connected by a shank and carrying a pulley means at one end, said drive means being operably connected to said pulley means.

8. The exercise machine according to claim 7, wherein said support frame includes a base and a rear cross member foldably connected to said base whereby said rear cross member can be pivoted into a storage position and a deployed position.

9. The exercise machine according to claim 8, wherein said base includes a latch means for releasably locking said rear cross member in deployed position.

10. An improved stair climbing exercise machine comprising:

a support frame, a base and a generally tubular inclined slide mast;

right and left foot-receiving pedals mounted on respective independently movable shuttles slidably received in channels at each side of said support means, each said shuttle having upper and lower glide portions connected by a shank and carrying a pulley means at one end; and electrically released drive means including an electric motor, a single drive shaft rotatable in one direction, drive linkage means for independently linking each shuttle to said drive shaft, and worm means for operable coupling said motor to said drive shaft, said worm means comprising a worm operably coupled to said motor and a worm gear mounted on said drive shaft, said drive linkage means comprising substantially similar independent right and left drive linkages, each linking the associated shuttle to said drive shaft, whereby movement of the shuttles is transferred to said drive shaft, each linkage including a recoil assembly mounted on said drive shaft and a continuous linking means for linking said recoil assembly and the associated shuttle, said linking means having a first end connected to the recoil assembly, a second end connected to the said frame, and an intermediate portion operably connected to said pulley means and including at least two generally parallel runs adapted to move in opposite directions relative to each other when the associated shuttle is moved, said generally parallel runs being received at each end thereof by independent idler means for receiving said linking means.

* * * * *